US011499489B2

(12) United States Patent
Kurtz et al.

(10) Patent No.: US 11,499,489 B2
(45) Date of Patent: Nov. 15, 2022

(54) ANNULAR RING MIXER WITH VANES

(71) Applicant: Ford Global Technologies, LLC, Dearborn, MI (US)

(72) Inventors: Eric Matthew Kurtz, Dearborn, MI (US); Liangjun Hu, Bloomfield Hills, MI (US); Daniel Joseph Styles, Canton, MI (US); Daniel William Kantrow, Ann Arbor, MI (US); Darrell Sparks, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/212,207

(22) Filed: Mar. 25, 2021

(65) Prior Publication Data

US 2022/0307436 A1 Sep. 29, 2022

(51) Int. Cl.

| | |
|---|---|
| ***F02D 41/00*** | (2006.01) |
| ***F02M 26/17*** | (2016.01) |
| ***F02M 26/14*** | (2016.01) |
| ***F02D 9/08*** | (2006.01) |
| ***F02M 26/19*** | (2016.01) |
| ***B01F 25/31*** | (2022.01) |
| ***B01F 25/43*** | (2022.01) |
| ***B01F 35/71*** | (2022.01) |
| ***B01F 23/10*** | (2022.01) |
| ***B01F 25/314*** | (2022.01) |
| ***B01F 25/431*** | (2022.01) |
| *B01F 101/00* | (2022.01) |

(52) U.S. Cl.

CPC ..... *F02D 41/0077* (2013.01); *B01F 23/19* (2022.01); *B01F 25/31* (2022.01); *B01F 25/3141* (2022.01); *B01F 25/4311* (2022.01); *B01F 35/718051* (2022.01); *F02D 9/08* (2013.01); *F02M 26/14* (2016.02); *F02M 26/17* (2016.02); *F02M 26/19* (2016.02); *B01F 2101/501* (2022.01)

(58) Field of Classification Search

CPC ..... B01F 3/026; B01F 5/0403; B01F 5/0473; B01F 5/0611; B01F 15/0261; B01F 2215/0085; F02D 9/08; F02D 41/0077; F02M 26/14; F02M 26/17; F02M 26/19

See application file for complete search history.

(56) References Cited

U.S. PATENT DOCUMENTS 4,461,150 A * 7/1984 Grohn ..... F02M 26/19 123/568.17
8,056,340 B2 * 11/2011 Vaught ..... F02B 33/44 60/605.2

(Continued)

FOREIGN PATENT DOCUMENTS

CN 2050478 U * 1/1990 ..... F02M 17/14
JP 6177604 B2 8/2017

*Primary Examiner* — Audrey B. Walter
(74) *Attorney, Agent, or Firm* — Vincent Mastrogiacomo; Brooks Kushman, P.C.

(57) ABSTRACT

An exhaust gas recirculation system for an engine includes a conduit, and a mixer. The conduit is configured to direct to direct exhaust gas away from an exhaust manifold. The mixer is configured to direct exhaust gas from the conduit, into an engine air intake system. The mixer is arranged with an exhaust gas mixing volute chamber having a plurality of mixing vanes configured to direct the exhaust gas into a central intake airflow upstream of an intake manifold.

11 Claims, 7 Drawing Sheets

(56) References Cited

U.S. PATENT DOCUMENTS

| | | | | |
|---|---|---|---|---|
| 10,012,184 | B2 * | 7/2018 | Guidi | F02M 26/06 |
| 10,428,711 | B2 | 10/2019 | Zhang | |
| 2016/0201610 | A1 * | 7/2016 | Dahl | F02M 26/19 123/568.17 |
| 2019/0017426 | A1 | 1/2019 | Zhang et al. | |
| 2020/0256266 | A1 * | 8/2020 | Mastbergen | F02M 35/10052 |
| 2020/0408173 | A1 * | 12/2020 | Zhong | F02M 26/70 |

* cited by examiner

ANNULAR RING MIXER WITH VANES

TECHNICAL FIELD

The present disclosure relates to exhaust gas recirculation systems for internal combustion engines.

BACKGROUND

Internal combustion engines may include exhaust gas recirculation systems that are configured to redirect exhaust gas into the air intake system of the engine to reduce emissions.

SUMMARY

A vehicle includes an internal combustion, an air intake system, an exhaust system, and an exhaust gas recirculation system. The internal combustion engine has at least one cylinder. The air intake system is configured to deliver air to the at least one cylinder. The exhaust system has a set of conduits configured to direct exhaust gas away from the at least one cylinder. The exhaust gas recirculation system has a at least one tube, and a mixer. The at least one tube is configured to direct the exhaust gas away from the set of conduits. The mixer is configured to direct the exhaust gas from the at least one tube, into the air intake system. The mixer forms an annular tube or ring that is disposed about an intake tube. The mixer includes at least one vane extending into a flow path of at least one of the exhaust gas and the air intake system. The mixer is configured to blend the exhaust gas and the air prior to introduction into the internal combustion engine.

An exhaust gas recirculation system for an engine includes a conduit, and a mixer. The conduit is configured to direct exhaust gas away from an exhaust manifold. The mixer is configured to direct exhaust gas from the conduit, into an engine air intake system. The mixer is arranged with an exhaust gas mixing volute chamber having a plurality of mixing vanes configured to direct the exhaust gas into a central intake airflow upstream of an intake manifold.

An exhaust gas recirculation mixer for an engine exhaust system includes a housing, an exhaust gas inlet, and at least one mixing vane. The housing forms an annular tube or ring that defines a central opening. The housing further defines an exhaust gas inlet and at least one mixing vane. The at least one mixing vane is configured between the exhaust gas inlet and the annular tube or ring. The at least one mixing vane includes a twist or slope to swirl an exhaust gas exiting the engine.

DETAILED DESCRIPTION

Figure 1:
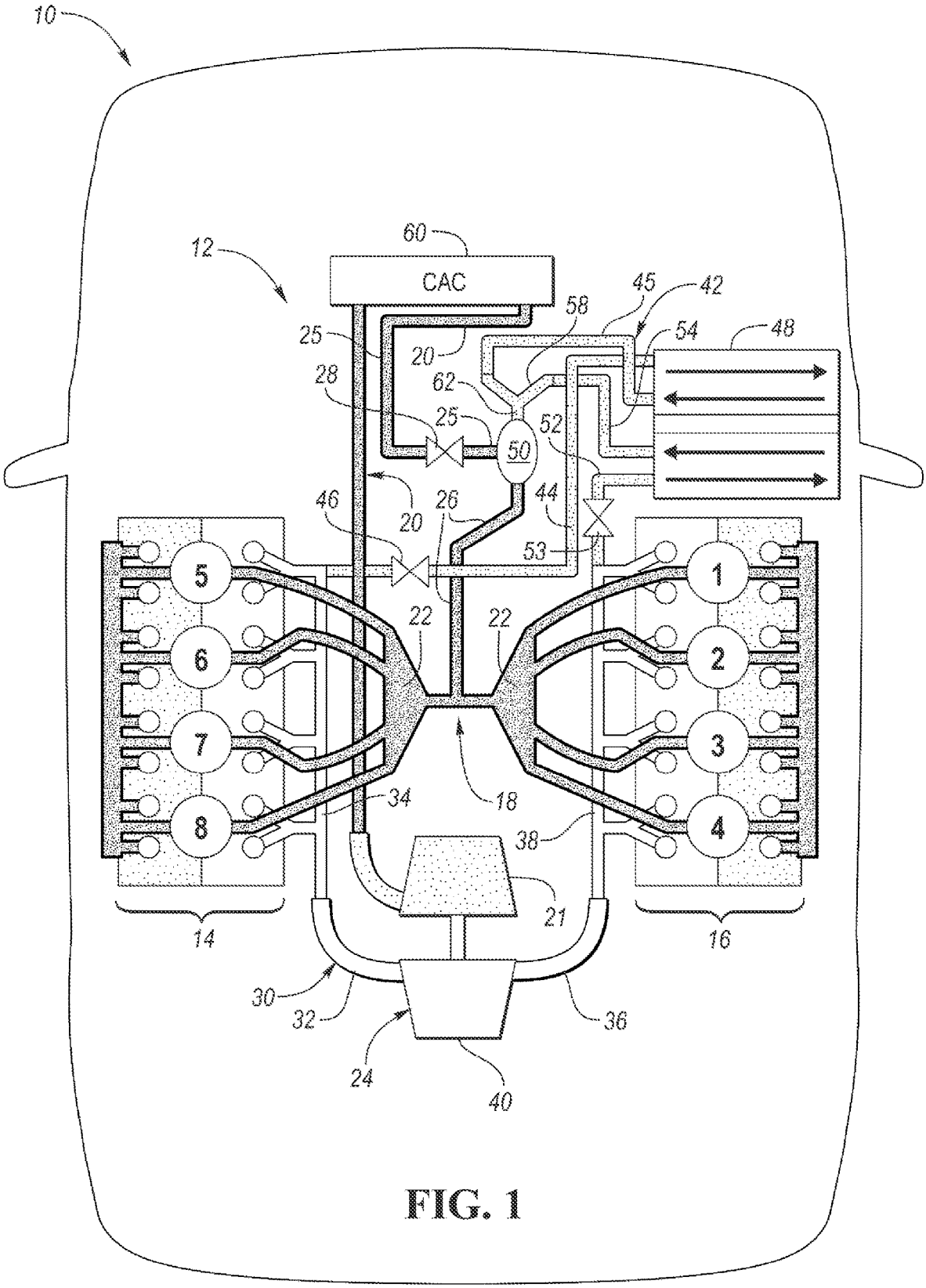
FIG. 1 is a schematic illustration of an exemplary vehicle having an internal combustion engine.

Embodiments of the present disclosure are described herein. It is to be understood, however, that the disclosed embodiments are merely examples and other embodiments may take various and alternative forms. The figures are not necessarily to scale; some features could be exaggerated or minimized to show details of specific components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for specific applications or implementations.

Exhaust gas recirculation is an important method to reduce NOx emissions of an internal combustion engine. With the more stringent emission criteria being established, especially with low NOx emission requirements, there is a strong need to improve the engine exhaust gas recirculation distribution uniformity. To meet the low NOx emission, an annular ring mixer can enable exhaust gas recirculation mixing while minimizing the pressure drop in the main flow of an engine intake. However, since current annular ring mixer devices distribute the exhaust gas over its outer periphery and the exhaust gas is well distributed over the circumference of the duct, it tends to enter the main flow at a primarily tangential velocity, thereby limiting the penetration of the exhaust gas into the main flow of the intake. One method to increase the exhaust gas recirculation drivability is to provide an annular ring mixer that includes a volute having a gradually reducing section area along the azimuthal direction to uniformly distribute and direct the exhaust gas to the main flow. The annular ring mixer may also break up the flow of the exhaust gas through the use of vanes or fins extending into the flow path of either the exhaust gas or the main intake flow thereby creating a mixing of the exhaust gas at a central path in the main flow.

In the current disclosure, an annular ring mixer design having a volute that may include a gradually reducing section area along the azimuthal direction to uniformly distribute and direct an exhaust gas to a main intake air flow is proposed. The annular ring mixer may include at least one vane or fin configured internally that may direct or guide the exhaust gas flowing through the volute toward a center of the main intake air flow is also proposed. The main goal is to enable improved exhaust gas mixing while maintaining the use of an annular ring mixer for reduced intake air pressure loss. The exhaust gas recirculation flow is diverted from the engine and cooled in an exhaust gas recirculation cooler. Then the cooled exhaust gas recirculation flows are introduced into the annular ring exhaust gas recirculation mixer. The exhaust gas recirculation flows do not mix with each other before mixing with the main air flow of the air intake system of the engine. Introducing the exhaust gas recirculation flows into the main air flow reduces the mixing losses and helps to maintain the pulsation energy, which increases the exhaust gas recirculation drivability and the penetration of the exhaust gas recirculation flow into the main air flow of the air intake system.

Referring to FIG. 1, a schematic illustration of an exemplary vehicle 10 having an internal combustion engine 12 is illustrated. The engine 12 may be configured to provide power and torque to wheels to propel the vehicle 10. The engine 12 may include any known configuration of cylinders such as, but not limited to a single cylinder bank engine having a single or a plurality of cylinders or a double cylinder bank engine having a plurality of cylinders, each bank of the double bank having an equal number of cylinders. The engine 12 may include any known configuration of two cylinders, three cylinders, four cylinders, six cylinders or other known vehicle engine configurations. As illustrated in the exemplary vehicle 10, the engine 12 includes a first bank of cylinders 14 and a second bank of cylinders 16.

The engine 12 includes an air intake system 18. The air intake system 18 includes a set of pipes, tubes, or conduits 20 that are configured to deliver an air supply to each cylinder to provide the oxygen required for the combustion of fuel. The set of pipes, tubes, or conduits 20 may include one or more first intake pipes tubes or conduits 25 housing a throttle valve 28, one or more second air intake pipes tubes or conduits 26 directly connected to one or more air intake manifolds 22, the intake manifolds 22 directly deliver the air into each cylinder. The first intake pipe, tube, or conduit 25 of the set of pipes, tubes, or conduits 20 may draw air directly from an ambient environment or may receive air from a compressor 21 of a turbocharger 24 or supercharger. If a turbocharger 24 or supercharger is delivering air the air intake system 18, the air may first be sent to a charge air cooler 60. From the charge air cooler 60, the air may then pass by the throttle valve 28, through the air intake manifolds 22 and into the cylinders of the first bank of cylinders 14 and of the second bank of cylinders 16. The throttle valve 28 is adjusted by an operator of the vehicle 10 by depressing an accelerator pedal (not shown) in conjunction with an adjustment to the amount of fuel being delivered into the cylinders based on a power or torque demand of the engine 12 or the wheels of the vehicle 10, which is interpreted by a controller (not shown) based on a position of the accelerator pedal.

The controller may be a powertrain control unit (PCU), may be part of a larger control system, and may be controlled by various other controllers throughout the vehicle 10, such as a vehicle system controller (VSC). It should therefore be understood that the controller and one or more other controllers can collectively be referred to as a "controller" that controls various actuators in response to signals from various sensors to control functions such as starting/stopping the engine 12, operating the engine 12 to provide wheel torque, select or schedule shifts of a transmission of the vehicle 10, etc.

The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the engine 12 or vehicle 10.

As illustrated, the engine 12 also includes an exhaust system 30. The exhaust system 30 is configured to direct exhaust gas away from the cylinders of the engine 12. The exhaust system 30 includes a first set of exhaust gas pipes, tubes, or conduits 32 that are configured to direct exhaust gas away from the first bank of cylinders 14. The first set of exhaust pipes, tubes, or conduits 32 may include a first exhaust manifold 34 that directly receives the exhaust gas from the first bank of cylinders 14. The exhaust system 30 may include a second set of exhaust pipes, tubes, or conduits 36 that are configured to direct exhaust gas away from the second bank of cylinders 16. The second set of exhaust pipes, tubes, or conduits 36 may include a second exhaust manifold 38 that directly receives the exhaust from the second bank of cylinders 16. The exhaust gas is channeled to one or more tail pipes (not shown), via the first set of exhaust pipes, tubes, or conduits 32 and the second set of exhaust pipes, tubes, or conduits 36, wherein the exhaust gas is dumped into the ambient environment outside the vehicle 10. At least one intermediate component of the exhaust system 30 may be disposed between the exhaust manifolds 34, 38 and the one or more tailpipes (not shown). Such intermediate component may include one or more mufflers, one or more catalytic converters, and a turbine 40 if the vehicle 10 includes the turbocharger 24, etc.

The engine 12 also include an exhaust gas recirculation system 42. The exhaust gas recirculation system 42 may include a first exhaust gas recirculation pipe, tube, or conduit 44 that is configured to direct a first portion of the exhaust gas away from the first set of exhaust pipes, tubes, or conduits 32 of the exhaust system 30. More specifically, the first exhaust gas recirculation pipe, tube, or conduit 44 may be configured to direct the first portion of the exhaust gas away from the first exhaust manifold 34, thereby directing the first portion of exhaust gas away from the first bank of cylinders 14. The first exhaust gas recirculation pipe, tube, or conduit 44 may be comprised of one or more pipes, tubes, or conduits. A first exhaust gas recirculation valve 46 may be disposed along the first exhaust gas recirculation pipe, tube, or conduit 44 to control the amount of exhaust flowing through the first exhaust gas recirculation pipe, tube, or conduit 44. The first exhaust gas recirculation pipe, tube, or conduit 44 directs the first portion of the exhaust gas into an exhaust gas recirculation cooler 48. The first portion of the exhaust gas is then directed toward a mixer 50 via a second pipe, tube, or conduit 45.

The exhaust gas recirculation system 42 may include a third exhaust gas recirculation pipe, tube, or conduit 52 that is configured to direct a second portion of the exhaust gas away from the second set of pipes, tubes, or conduits 36 of the exhaust system 30. More specifically, the third exhaust gas recirculation pipe, tube, or conduit 52 may be configured to direct the second portion of the exhaust gas away from the second exhaust manifold 38, thereby directing the second portion of exhaust gas away from the second bank of cylinders 16. The third exhaust gas recirculation pipe, tube, or conduit 52 may be comprised of one or more pipes, tubes, or conduits. A second exhaust gas recirculation valve 53 may be disposed along the third exhaust gas recirculation pipe, tube, or conduit 52 to control the amount of exhaust flowing through the third exhaust gas recirculation pipe, tube, or conduit 52. The third exhaust gas recirculation pipe, tube, or conduit 52 directs the second portion of the exhaust gas into the exhaust gas recirculation cooler 48. The first and second portions of the exhaust gas may be combined into a single flow path in the exhaust gas recirculation cooler 48 or the first and second portions of exhaust gas may be segregated from each other when passing through the exhaust gas recirculation cooler 48. The second portion of the exhaust gas is then directed toward the mixer 50 via a fourth pipe, tube, or conduit 54. The fourth pipe, tube, or conduit 54 may be comprised of one or more pipes, tubes, or conduits.

It should be understood that the second pipe, tube, or conduit 45 and the fourth pipe, tube, or conduit 54 may be directly connected to the mixer 50 or alternatively the second and fourth conduits may be connected to the mixer 50 through a Y-pipe, Y-tube or Y-conduit 58 as the mixer 50 may include a single inlet port 62. The mixer 50 then delivers the first and second portion of the exhaust gas into the pipes, tubes, or conduits 26 of the air intake system 18 as a homogenous exhaust gas. The mixer 50 then delivers the homogenous exhaust gas into the pipes, tubes, or conduits 26 of the air intake system 18.

Referring to FIGS. 2 through 5, an exemplary embodiment of a mixer 100 for an exhaust gas recirculation system is illustrated. The embodiment of the mixer 100 may correspond to mixer 50 in FIG. 1. The mixer 100 is configured to direct and homogenize the exhaust gas from the second pipe, tube, or conduit 44, the fourth pipe, tube, or conduit 54, or the Y-pipe, Y-tube, or Y-conduit 58, with the intake air coming from the ambient environment or the charge air cooler 60. As discussed previously, the intake air or a central airflow 64 enters the mixer 100 from the first intake pipes tubes or conduits 25, exiting the central airflow 64 past at least one exhaust gas outlet 112 configured about an annular tube or ring 104 to introduce the exhaust gas into the air intake pipes, tubes, or conduits 26 of the air intake system 18 enabling better mixing efficiency of the exhaust gases while minimizing any pressure drop across the system.

The mixer 100 includes a housing 102 defining a mixer volute 106 extending between an exhaust gas inlet 110 and the at least one exhaust gas outlet 112. The mixer volute 106 may include a first end 118 having a first circumference and a gradually reducing section area along an azimuthal direction extending to a second end 130 having a second circumference, the second end 130 second circumference being smaller than the first end 118 first circumference. The mixer volute 106 includes the two different sized first end 118 and second end 130 to uniformly distribute and direct the exhaust gas to the main intake air flow 64 to promote turbulence allowing for a more thorough mixing of the exhaust gas with the main intake air flow 64. The annular tube 104 may comprise one of the pipes, tubes, or conduits 20 and the air intake pipes, tubes, or conduits 26 of the air intake system 18 configured downstream of the throttle valve 28 and upstream of the intake manifolds 22. As specifically illustrated in FIGS. 2-3D, the throttle valve 28 may include at least one of a substantially planar disc throttle plate 72, a single side twist disc throttle plate 82 and a double side twist disc throttle plate 92. With specific reference to FIG. 2, the substantially planar disc throttle plate 72 is shown. The substantially planar disc throttle plate 72 is attached to a pivot shaft 74, the substantially planar disc throttle plate 72 may be removably attached with a threaded fastener 70 or permanently attached via a rivet or other known mechanical attachment method. The pivot shaft 74 may be configured to extend through a side wall of the intake tube 25 or an aperture (not illustrated) may be used to gain access to an end of the pivot shaft 74.

Figure 2:
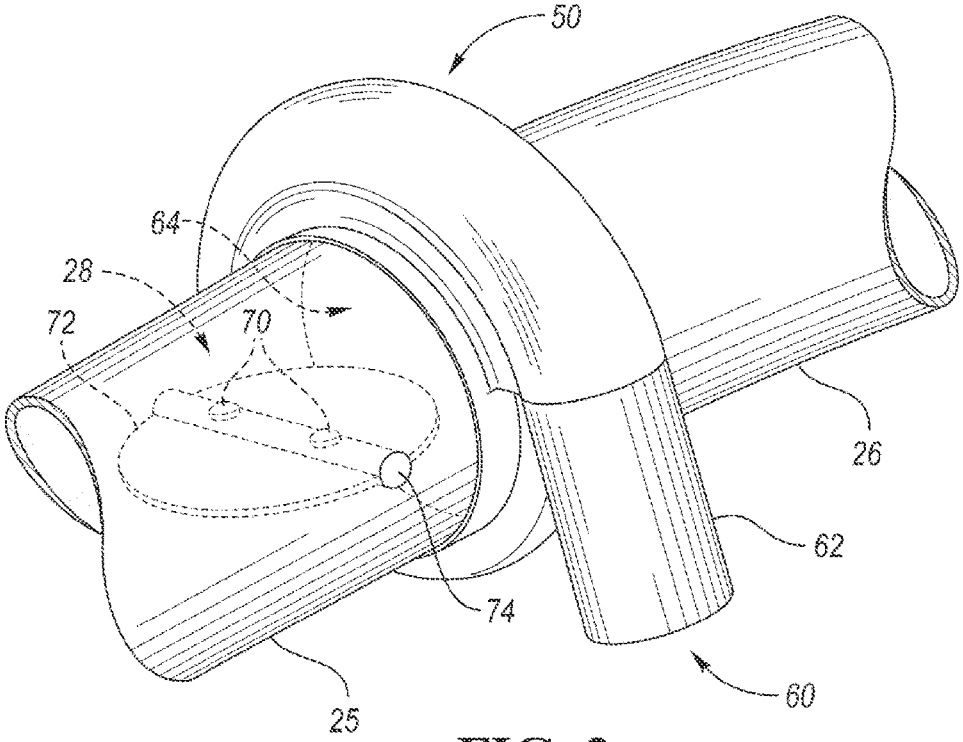
FIG. 2 is a perspective view of an exemplary intake system having an air intake tube with a planar throttle body plate and an exemplary mixer for an exhaust gas recirculation system.

As illustrated in FIG. 2, the pivot shaft 74 is extending through and support by the intake tube 25 along a central plane (not shown) of the intake tube 25 such that the pivot shaft 74 and the attached substantially planar disc throttle plate 72 are centered in the intake tube 25. The exposed end of the pivot shaft 74 may be connected to any known rotational actuation device to rotate the pivot shaft 76 thereby opening and closing the throttle valve 28 allowing the throttle plate 72 to vary the volume of the central airflow 64 flowing into the mixer 50, such that when the substantially planar disc throttle plate 72 is rotated to a vertical position the central air flow 64 is blocked and when the substantially planar disc throttle plate 72 transitioned from the vertical position the central air flow 64 can flow across the substantially planar disc throttle plate 72 and through the mixer 50, as discussed above.

Figure 3A:
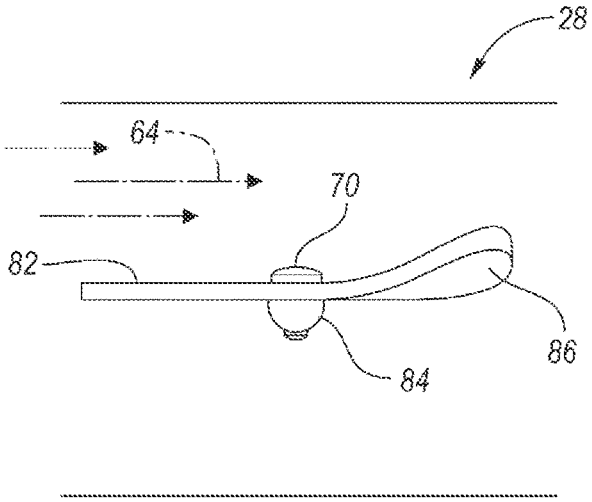
FIG. 3A is a side view of an exemplary single twist throttle plate configured in an intake tube.
Figure 3B:
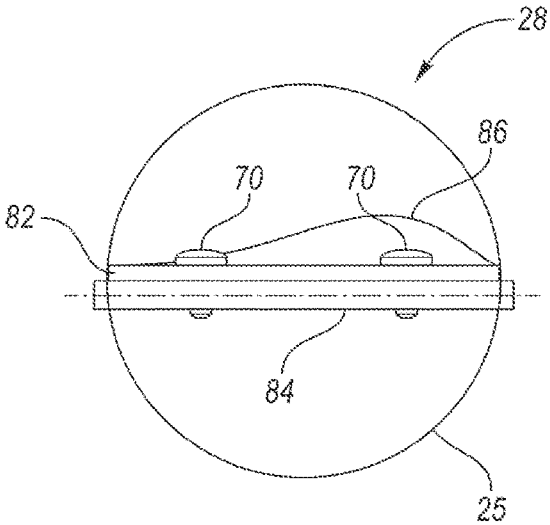
FIG. 3B is a front view of the exemplary single twist throttle plate of FIG. 3A, configured in an intake tube.

Turning to FIGS. 3A and 3B, a single twist throttle plate 82 is illustrated. The single twist throttle plate 82 includes a substantially planar side and a sloped/twisted side 86, the sloped/twisted side allows the central air flow 64 to be lifted or interrupted as the central air flow 64 moves from the intake tube 25 and into the central opening 116, 216 and 316 of the mixer 50. This lift may create turbulence within the air intake tube 25 and ultimately promote additional blending of the exhaust gas as the central air flow 64 passes through the mixer 50. The sloped/twisted side 86 may transition upward or downward from the substantially planar side at about a midsection of the single twist throttle plate 82 adjacent the mechanical fasteners 70, which attach the single twist throttle plate 82 to the pivot shaft 84.

Figure 3C:
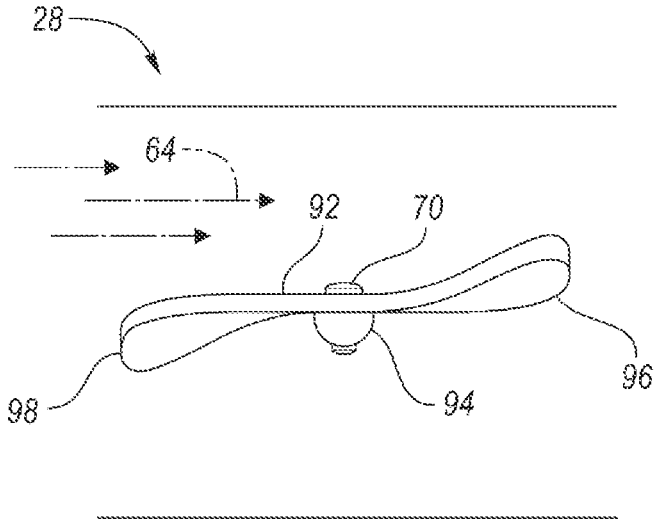
FIG. 3C is a side view of an exemplary double twist throttle plate configured in an intake tube.
Figure 3D:
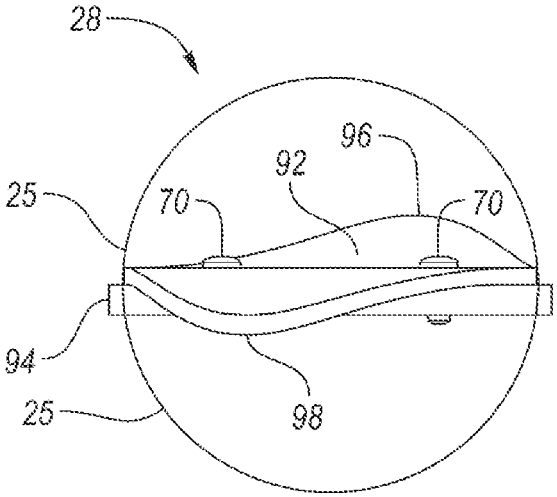
FIG. 3D is a front view of the exemplary double twist throttle plate of FIG. 3C, configured in an intake tube.
Figure 4:
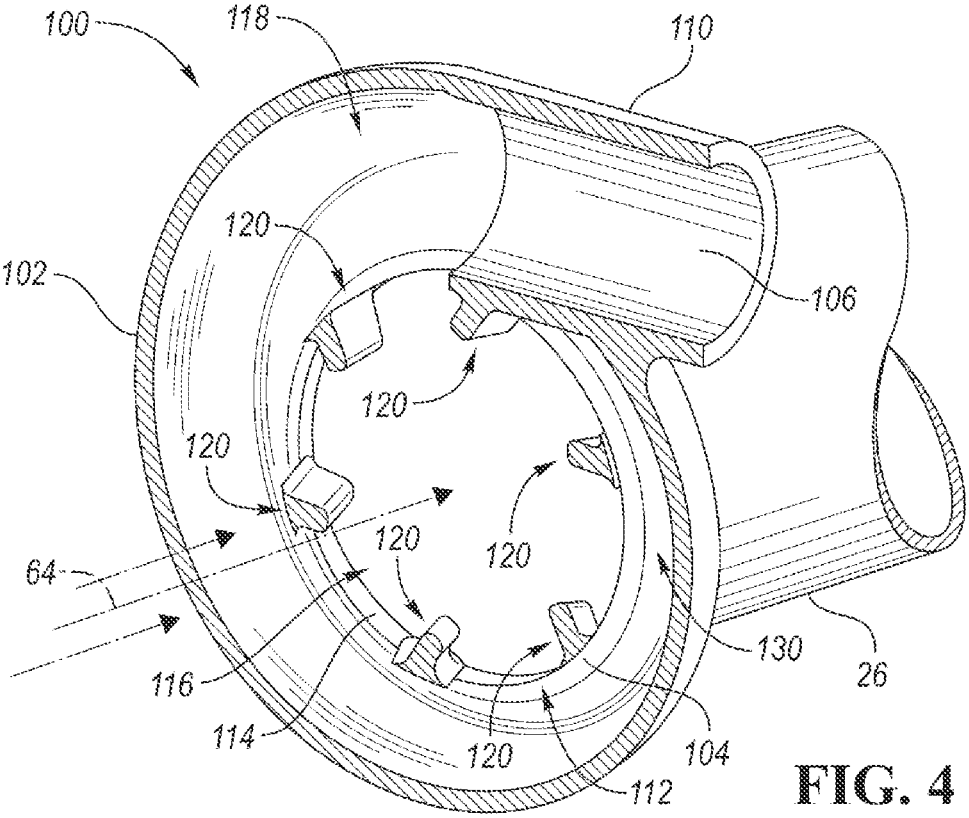
FIG. 4 is a cross-sectional view of the mixer for the exhaust gas recirculation system including fixed twist vanes of FIG. 2 taken along a central vertical plane.
Figure 5:
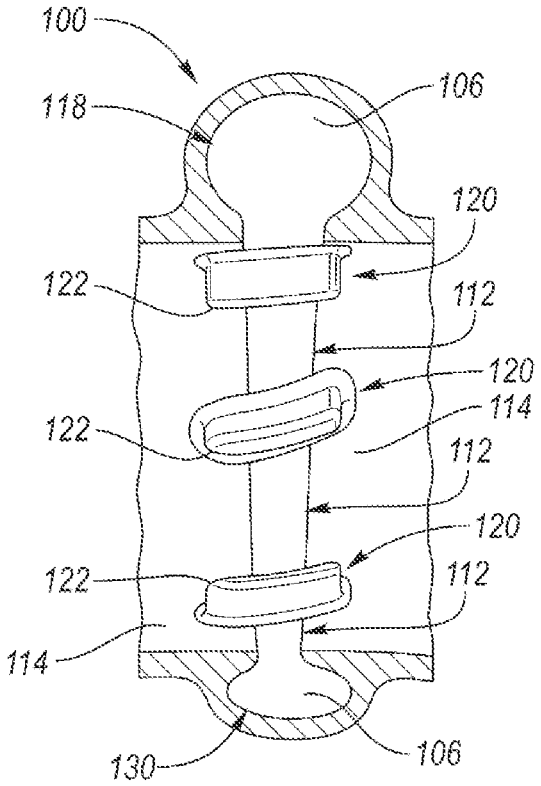
FIG. 5 is a cross-sectional view of the mixer for the exhaust gas recirculation system including fixed twist vanes of FIG. 2 taken along a horizontal plane.

FIGS. 3C and 3D illustrate the double side twist disc throttle plate 92. The double side twist disc throttle plate 92 may include a substantially planar midsection where the pivot shaft 94 is attached. A first sloped/twisted side 96 may transition upward or downward from substantially planar midsection while the second sloped/twisted side 98 is positioned at an opposite side of the pivot shaft 94 and may transition upward or downward from the substantially planar midsection. Further, when the first sloped/twisted side 96 is transition upward the second sloped/twisted side 98 will be positioned downward and when the first sloped/twisted side 96 is transition downward the second sloped/twisted side 98 will be positioned upward such that the two sides 96, 98 may transition in opposite directions. However, it is contemplated that the upward and downward positions may be in any configuration including in the same direction that allows the central air 64 to flow across the two sides 96, 98 and creates an interrupted air flow to promote swirling within the mixer 50 to blend the exhaust gases with the central air flow 64.

The annular tube 104 may include an inner diameter 114 defining a central opening 116 and encompassing the central airflow 64. Additionally, an at least one vane or fin 120 may extend out from the annular tube 104 protruding inwardly and away from the inner diameter 114 of the central opening 116 toward the central airflow 64. The at least one exhaust gas outlet 112 may be a single aperture or a plurality of apertures divided by at least one vane or fin 120 extending across the at least one gas outlet 112. The exhaust gas outlet 112 allows the exhaust gas to exit the mixer volute 106 flowing into the central airflow 64 of the air intake system 18 while flowing over and around a vane or fin outer surface 122.

Figure 6:
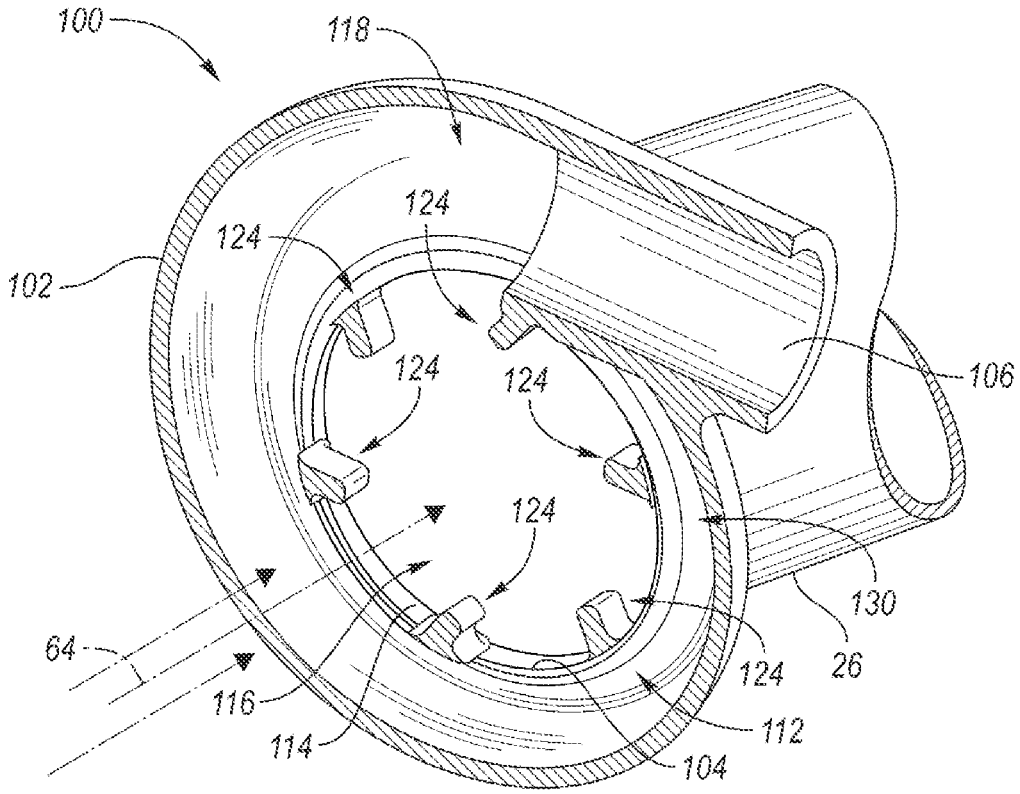
FIG. 6 is a cross-sectional view of the mixer for the exhaust gas recirculation system including fixed straight vanes of FIG. 2 taken along the central vertical plane.
Figure 7:
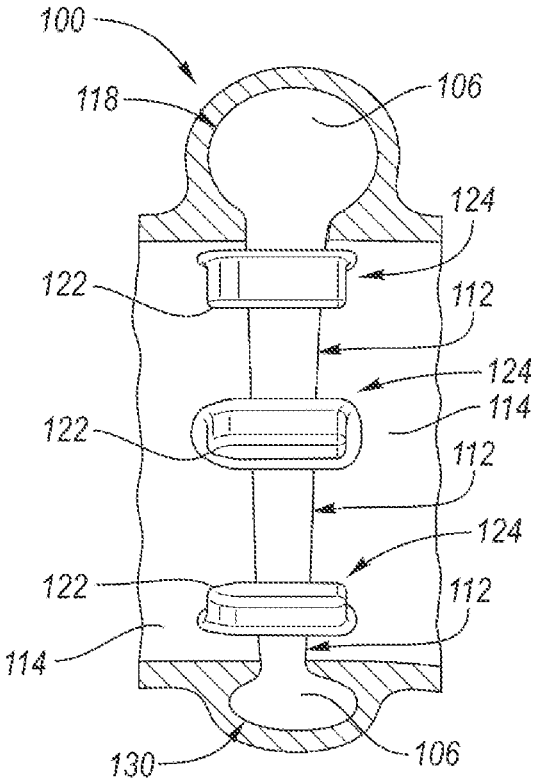
FIG. 7 is a cross-sectional view of the mixer for the exhaust gas recirculation system including fixed straight vanes of FIG. 2 taken along the horizontal plane.

The vane or fin 120 is an obstruction that may extend into the flow path of the exhaust gas and the central airflow 64. The exhaust gas may flow over and around the vane or fin outer surface 122 allowing the vane or fin outer surface 122 to project and disrupt the flow of the exhaust gas thereby providing further mixing and stirring of the entrained exhaust gas with the central airflow 64 to homogenize the intake air entering the intake manifold 22 of the combustion engine 12. The at least one vane or fin 120 may be a single vane or fin or a plurality of vanes or fins configured radially about the annular tube 104. The vane or fin 120 may be configured linearly extending across the exhaust gas outlet 112 along an axis of the annular tube 104 or the vane or fin 120 may be positioned at an angle or twist as illustrated at least in FIGS. 4 and 5 or it may be configured as a straight vane or fine 124 as illustrated in FIGS. 6 and 7. Additionally, it should be understood that the angle of the twist may and a slope of the vane or fins 120, 124 may affect the velocity of the exhaust gas or the central airflow 64 by increasing or decreasing as desired for a specific application.

Figure 8:
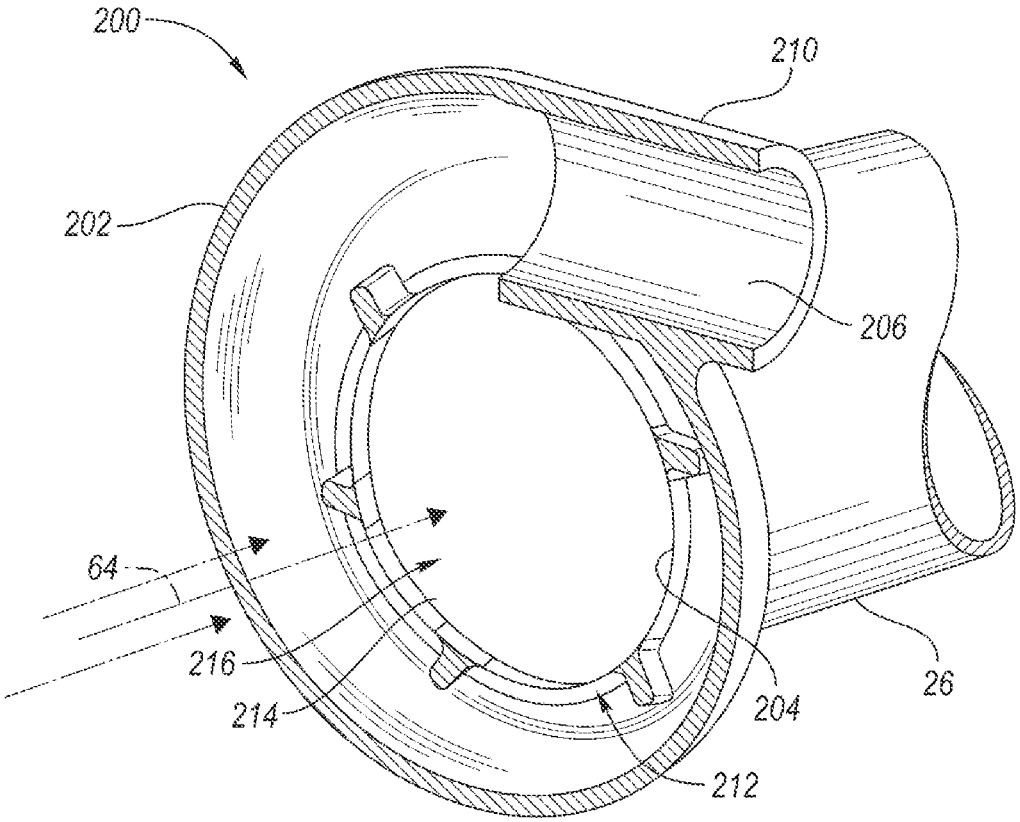
FIG. 8 is a cross-sectional view of the mixer for the exhaust gas recirculation system including fixed inverted vanes of FIG. 2 taken along the central vertical plane.
Figure 9:
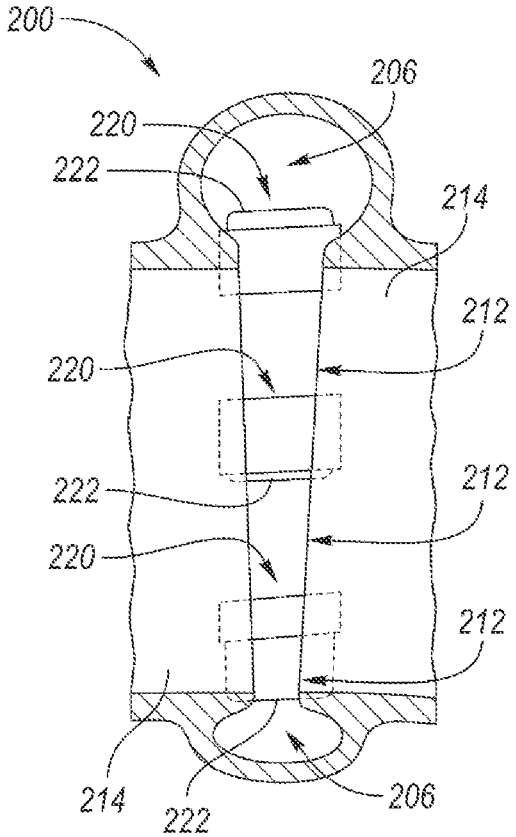
FIG. 9 is a cross-sectional view of the mixer for the exhaust gas recirculation system including fixed inverted vanes of FIG. 2 taken along the horizontal plane.

Referring to FIGS. 8 and 9, a second embodiment of a mixer 200 for an exhaust gas recirculation system is illustrated. The mixer 200 may correspond to mixer 50 in FIG. 1. The mixer 200 is configured to direct and homogenize the exhaust gas from the second pipe, tube, or conduit 44, the fourth pipe, tube, or conduit 54, or the Y-pipe, Y-tube, or Y-conduit 58, with the intake air coming from the ambient environment or the charge air cooler 60. Similarly as discussed previously, the intake air or the central airflow 64 enters the mixer 200 from the set of pipes, tubes, or conduits 20, exiting the central airflow 64 through at least one exhaust gas outlet 212 configured about and annular tube 204 to introduce the exhaust gas into the air intake pipes, tubes, or conduits 26 of the air intake system 18 enabling better mixing efficiency of the exhaust gases with minimized pressure drop across the system.

The mixer 200 includes a housing 202 defining a mixer volute 206 extending between an exhaust gas inlet 210 and the at least one exhaust gas outlet 212. The annular tube 204 may comprise one of the pipes, tubes, or conduits 20 and the air intake pipes, tubes, or conduits 26 of the air intake system 18 configured downstream of the throttle valve 28 and upstream of the intake manifolds 22. The annular tube 204 may include an inner diameter 214 defining a central opening 216 and encompassing the central airflow 64. Additionally, an at least one vane or fin 220 may extend from the annular tube 204 protruding inwardly into the mixer volute 206 from the inner diameter 214 of the central opening 216. The at least one exhaust gas outlet 212 may be a single aperture or a plurality of apertures divided by the at least one vane or fin 220 extending across the at least one gas outlet 212. The exhaust gas outlet 212 allows the exhaust gas to exit the mixer volute 206 flowing into the central airflow 64 of the air intake system 18 while flowing over and around a vane or fin outer surface 222.

The vane or fin 220 is an obstruction that may extend outward toward the housing 202 extending into the flow path of the exhaust gas in the mixer volute 206. As the exhaust gas flows through the mixer volute 206 and over the vane or fin outer surface 222 the exhaust gas flow may be disrupted and directed radially inward of the mixer 200 and into the central airflow 64. The vane or fin 220 further providing homogenization through turbulence of the exhaust gas as it enters the central airflow 64 to promote mixing between the entrained exhaust gas and the intake air entering the intake manifold 22 of the combustion engine 12. The at least one vane or fin 220 may be a single vane or fin or a plurality of vanes or fins configured radially about the annular tube 204. The vane or fin 220 may be configured linearly extending straight across the exhaust gas outlet 212 along an axis of the annular tube 204 or the vane or fin 220 may be positioned at an angle or twist. Additionally, it should be understood that the angle of the twist and a slope of the vane or fine 220 may affect the velocity of the exhaust gas or the central airflow 64 by increasing or decreasing as desired for a specific application.

Figure 10:
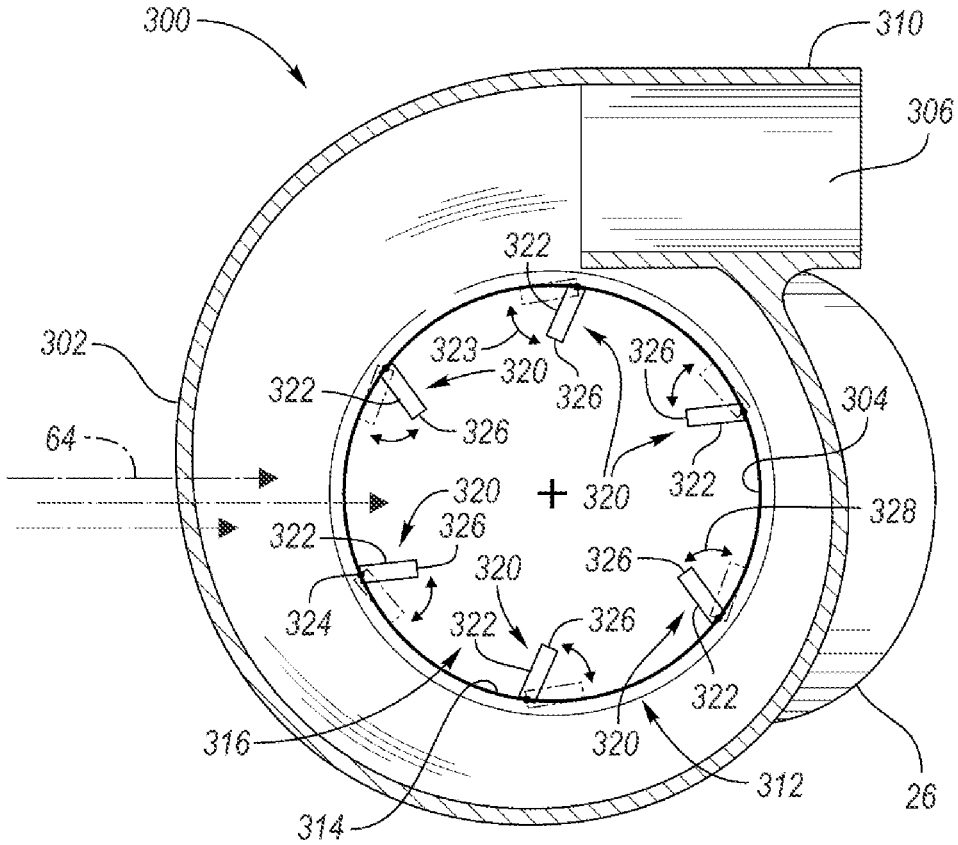
FIG. 10 is a cross-sectional view of the mixer for the exhaust gas recirculation system including fixed dynamic vanes of FIG. 2 taken along the central vertical plane.
Figure 11:
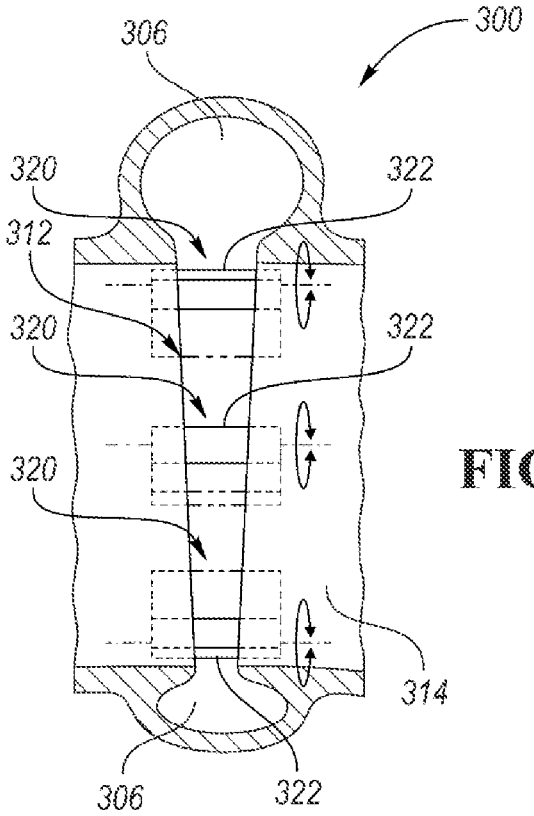
FIG. 11 is a cross-sectional view of the mixer for the exhaust gas recirculation system including fixed dynamic vanes of FIG. 2 taken along the horizontal plane.

Referring to FIGS. 10 and 11, a third embodiment of a mixer 300 for an exhaust gas recirculation system is illustrated. The mixer 300 may correspond to mixer 50 in FIG. 1. The mixer 300 is configured to direct and homogenize the exhaust gas from the second pipe, tube, or conduit 44, the fourth pipe, tube, or conduit 54, or the Y-pipe, Y-tube, or Y-conduit 58, with the intake air coming from the ambient environment or the charge air cooler 60. Similarly as discussed previously, the intake air or the central airflow 64 enters the mixer 300 from the set of pipes, tubes, or conduits 20, exiting the central airflow 64 through at least one exhaust gas outlet 312 configured about and annular tube 304 to introduce the exhaust gas into the air intake pipes, tubes, or conduits 26 of the air intake system 18 enabling better mixing efficiency of the exhaust gases with minimized pressure drop across the system.

The mixer 300 includes a housing 302 defining a mixer volute 306 extending between an exhaust gas inlet 310 and the at least one exhaust gas outlet 312. The annular tube 304 may comprise one of the pipes, tubes, or conduits 20 and the air intake pipes, tubes, or conduits 26 of the air intake system 18 configured downstream of the throttle valve 28 and upstream of the intake manifolds 22. The annular tube 304 may include an inner diameter 314 defining a central opening 316 and encompassing the central airflow 64. Turning specifically to FIG. 10, an exemplary at least one dynamic vane or fin 320 is illustrated. The at least one dynamic vane or fin 320 may be a plurality of at least one dynamic vane or fins 320 that may rotatably extend out from the annular tube 304. The at least one dynamic vane or fin 320 may be configured radially about the annular tube 304 in a rotatable and overlapping configuration to at least partially or fully close of the flow of exhaust gas. The at least one dynamic vane or fin 320 may be manually adjustable and set to a preconfigured and fixed angle. Alternatively, the at least one dynamic vane or fin 320 may be configured to rotate and adjust the angle of the at least one dynamic vane or fin 320 relative to the exhaust gas outlet 312. Thus, in order to rotate, the at least one dynamic vane or fin 320 may be pinned or rotatably affixed to the annular tube 304 at a first end 324 with a movable second end 326 allowing the at least one dynamic vane or fin 320 to rotate about an arc 328 and control the exhaust gas flow by opening and closing, at least partially the at least one exhaust gas outlet 312. This pivoting or rotation of the at least one dynamic vane or fin 320 may thereby alter the flow area of exhaust gas out of the mixer volute 306 prior to and during introduction of the exhaust gas into the central airflow 62 in the air intake 25. In this configuration the at least one dynamic vane or fin 320 may include an activation device (not illustrated) connected to the first end 324 to rotate and or transition the at least one dynamic vane or fin 320 to vary the angle of the fin or the size of the exhaust gas outlet 312 to project and disrupt the exhaust gas to further promote the mixing and homogenization of the exhaust gas with the central airflow 64 prior to introduction into the intake manifold 22 of the combustion engine 12.

Additionally, when the at least one dynamic vanes and fins 320 are configured to rotate to adjust the angle relative to a tangential, the exhaust gas velocity will increase or decrease to a desired exhaust gas velocity depending on the predetermined angle. The angle of rotation relative to the tangential may be in a range of 0 to 90 degrees. During a low speed condition of the vehicle 10 the exhaust gas velocity may be low and the angle may be increased to a range of about 20 degrees to about 80 degrees and when the vehicle 10 is under a high speed/load condition the angle could be set to a range of about 0 degrees to about 20 degrees thereby reducing any potential flow loss in the central airflow 64. Thus, the exhaust gas may be balanced depending on the load conditions of the combustion engine 12.

It should be understood that mixers 100, 200, and 300 may be interchangeable and may be include any one of the features discussed herein either individually or in combination. Specifically, the mixers 100, 200, and 300 may be configured with the volute 106 alone without any vanes, they may be configured with a combination of the volute 106 and the vanes, and they may be configured with a combination of the different vanes illustrated in the various mixer embodiments 100, 200, and 300. It should be understood that the designations of first, second, third, fourth, etc. for any component, state, or condition described herein may be rearranged in the claims so that they are in chronological order with respect to the claims. Additionally, the different embodiments disclosed herein may be implemented individually or in any combination, the specific arrangements are examples and do not limit any combination.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising:

an internal combustion engine having at least one cylinder;

an air intake system configured to deliver air to the at least one cylinder; and an exhaust system having;

a set of conduits configured to direct an exhaust gas away from the at least one cylinder, and an exhaust gas recirculation system having, at least one tube configured to direct the exhaust gas away from the set of conduits, and a mixer configured to direct the exhaust gas from the at least one tube into the air intake system, wherein the mixer forms an annular ring having a continuous volute chamber exhaust gas opening disposed radially around an inner diameter of the annular ring and attached to an intake tube, the annular ring is a portion of the air intake system that is configured downstream of a throttle valve and upstream of an intake manifold, the throttle valve includes at least one of a single twist throttle plate or a double twist throttle plate, the mixer includes at least one vane extending across the volute chamber opening and into a flow path of at least one of the exhaust gas and the air intake system, and the at least one vane has an outer surface and is configured to blend the exhaust gas and the air flowing over the outer surface and prior to introduction into the internal combustion engine.

2. The vehicle of claim 1, wherein the at least one vane is at least one of a fixed position and a moveable position, the fixed position is configured at a predetermined angle to provide a predetermined velocity of the exhaust gas, and the moveable position is a dynamic position configured to adjust the angle of the at least one vane automatically as determined by a load of the internal combustion engine and a throttle valve position.

3. The vehicle of claim 1, wherein the annular ring includes at least one exhaust gas outlet or aperture configured radially around the annular ring at the volute chamber exhaust gas opening.

4. The vehicle of claim 3, wherein the at least one vane is at least one of a straight vane, a dynamic vane, an inverted vane and a twist vane, the dynamic vane is at least one of a straight vane, a twist vane and an inverted vane, and the dynamic vane is configured to rotate to at least one of an open position, a partially open position and a closed position.

5. The vehicle of claim 1, wherein the annular ring defines a volute chamber having a gradually reducing section area along an azimuthal direction, and the volute chamber is configured to direct the exhaust gas from an exhaust gas intake conduit to the continuous volute chamber exhaust gas opening.

6. The vehicle of claim 5, wherein the at least one vane is a plurality of vanes configured radially around the annular ring, and each vane divides the continuous volute chamber exhaust gas opening into a plurality of exhaust gas outlets extending around the annular ring.

7. The vehicle of claim 5, wherein the at least one vane is configured to extend at least one of into the volute chamber and into the intake tube.

8. An engine exhaust gas mixer comprising:

a housing forming an annular ring that defines a central opening extending radially around an inner diameter of the annular ring, the housing further defining, an exhaust gas inlet, an air intake including a twist throttle plate, the twist throttle plate having at least one curved end, the curved end directing an intake air in a non-laminar flow path, and at least one mixing vane configured between the exhaust gas inlet and the annular ring, the at least one mixing vane extending across the central opening and including at least one of a twist or slope to swirl an exhaust gas of the engine as the exhaust gas flows over an outer surface of the at least one mixing vane.

9. The engine exhaust gas mixer of claim 8, further comprising an exhaust gas mixing volute configured between the exhaust gas inlet and the central opening.

10. The mixer of claim 9, wherein the at least one mixing vane is fixed at an angle relative to a flow path of an intake air.

11. The mixer of claim 9, wherein the at least one mixing vane is configured at least partially extending into at least one of the central opening and the exhaust gas mixing volute.

* * * * *